United States Patent [19]

Lindquist

[11] 4,446,572

[45] May 8, 1984

[54] CAMOUFLAGED NURSING DRESS

[76] Inventor: Rosaland O. Lindquist, 4084 W. 7th St., Los Angeles, Calif. 90005

[21] Appl. No.: 522,509

[22] Filed: Aug. 12, 1983

[51] Int. Cl.[3] ..... A41D 1/20

[52] U.S. Cl. ..... 2/104

[58] Field of Search ..... 2/104, 105, 74; 128/460, 425

[56] References Cited

U.S. PATENT DOCUMENTS

| | | | |
|---|---|---|---|
| 643,113 | 2/1900 | Eveleth | 2/104 |
| 1,206,480 | 11/1916 | Stagg | 2/104 |
| 4,144,593 | 3/1979 | Timmons | 2/104 |

*Primary Examiner*—Doris L. Troutman

*Attorney, Agent, or Firm*—Ralph B. Pastoriza

[57] ABSTRACT

The nursing dress includes an outer dress portion covering the torso of a woman and having a given color and design. An under dress portion, in turn, covers the torso from the inside upper front margin of the outer dress portion and extends downwardly over the top areas of the breasts to within a short distance of the nipples and is of the same color and design as the outer dress portion. This under dress portion may be detachably secured to the inside of the outer dress portion at the shoulders and side arm areas. An exposing arrangement such as zippers or buttons on the front of the outer dress portion permits an area of the outer dress portion to be removed from in front of the torso to expose the under dress portion and an uncovered area of a breast for nursing a child. Since the under dress portion has the same color and design as the outer dress portion, it blends in with the remaining front of the outer dress portion to camouflage the fact that an area of the outer dress portion has been removed.

3 Claims, 5 Drawing Figures

CAMOUFLAGED NURSING DRESS

FIELD OF THE INVENTION

This invention relates generally to women's dresses, and more particularly to a camouflaged nursing dress.

BACKGROUND OF THE INVENTION

Over the last several years, a woman nursing her child in a public or semi-public area has become less objectionable than in prior decades. This new attitude is in part a consequence of the so-called "sexual revolution" and in part a result of a generally more casual attitude respecting social conventions.

As a result of the foregoing, there have been introduced onto the market various types of nursing garments in which an attempt is made to maintain a proper styling and fashion for the garment or dress and yet permit the same to function as a nursing dress in that a part can be opened up to expose a woman's breast for nursing a child. One example of such a garment is shown in U.S. Pat. No. 4,144,593 wherein a large hinged front panel is provided on a dress or blouse so designed that it can be loosened at its lower end and a baby inserted up under the loosened panel to nurse without exposing the woman's breast.

Two other examples of recently designed nursing garments are shown in U.S. Pat. Nos. 4,004,294 and 4,208,743. The first of these patents relates to a blouse design having left and right panels in front of the wearer's left and right breasts, respectively, these panels being camouflaged to look like pockets. The outer panel of each pocket can be pulled downwardly to expose the woman's nursing bra. The second of these two patents relates to a dress having open apertures on each side under the arm, the apertures being located such that either breast can be easily exposed for nursing a child. An inside panel which can be moved out of the way is normally provided for covering the breast so that the breast will not be exposed through these apertures.

While these recently introduced designs make it simpler for a woman to nurse her child in a public or semi-public area without attracting appreciable attention, there are still problems associated with such designs. First, the styling of the dress is always somewhat limited in view of the apparent necessity to provide apertures or pockets which camouflage apertures and the like. Second, where large openings or large flaps or panels are involved to cover a child's head, the nursing mother must be concerned that the child still receives sufficient air and will not become "smothered".

BRIEF DESCRIPTION OF THE PRESENT INVENTION

With the foregoing considerations in mind, the present invention contemplates an improved camouflaged nursing dress wherein less restrictions are placed on the styling of the dress and yet the same is functionally designed so as to permit easy nursing of a child.

More particularly, in accord with this invention, the dress includes an outer dress portion covering the torso and of a given color and design which may be completely arbitrary. An under dress portion, in turn, covers the front of the torso from the inside upper front margin of the outer dress portion and extends downwardly over the top areas of the breasts to within a short distance of the nipples and is of the same color and design as the outer dress portion. This under dress portion is attached to the inside shoulder and side arm portions of the outer dress portion and the outer dress portion itself includes an exposing means which might comprise zippers, for example, permitting an area of the outer dress portion to be removed from in front of the torso to expose the under dress portion and uncovered areas of the breasts for nursing a child. Since the color and design of the under dress portion is the same as the color and design of the outer dress portion, it will blend in with the remaining front of the outer dress portion to camouflage the fact that an area of the outer dress portion has been removed.

BRIEF DESCRIPTION OF THE DRAWINGS

A better understanding of this invention will be had by now referring to the accompanying drawings in which.

DETAILED DESCRIPTION OF THE INVENTION

Figure 1:
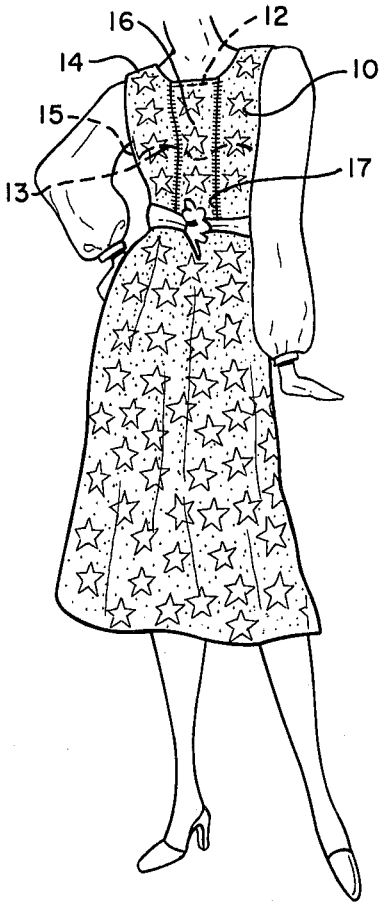
FIG. 1 illustrates an example of a camouflaged nursing dress in accord with the present invention.
Figure 2:
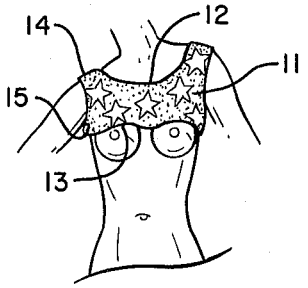
FIG. 2 shows an under portion of the dress not visible in FIG. 1.

Referring to both FIGS. 1 and 2, the camouflaged nursing dress includes an outer dress portion shown at 10 in FIG. 1 of a given color and design. The dress further includes an under dress portion 11 illustrated in FIG. 2 which covers the front of the torso. As shown, the upper margin of this under dress indicated at 12 extends from the inside upper front margin of the outer dress portion downwardly over the top areas of the breasts to terminate at 13 a short distance from the nipples. This under dress portion is of the same color and design as the outer dress portion, as will be evident from observing both FIGS. 1 and 2.

Appropriate attachment means are provided at the shoulders 14 and side arm portions 15 of the under dress for securing the same to corresponding parts of the inside of the outer dress portion 10.

In accord with a feature of the present invention, this under dress portion 11 can be removed from inside the outer dress portion 10 when it is no longer necessary for a woman to nurse her child, so that the dress shown in FIG. 1 can be worn in a conventional manner.

In order to provide access to the woman's breast, the outer front portion 10 includes an exposing means in the form of a rectangular, generally vertical panel 16. Appropriate zippers such as indicated at 17 extend along the left and right longitudinal edges of this panel to the top of the panel. By this arrangement, downward zipping permits the panel to be folded downwardly to expose the under dress portion 11.

Figure 3:
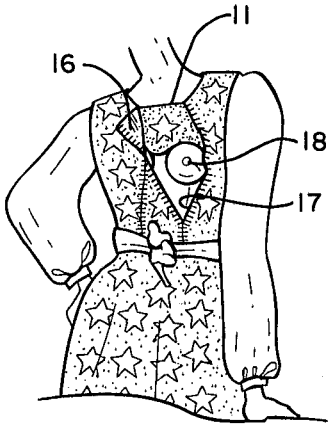
FIG. 3 illustrates the manner in which the wearer's breast is exposed for nursing a child.

FIG. 3 illustrates the left hand zipper 17 as having been zipped downwardly to permit swinging of the panel 16 away from the woman's left breast to expose the nipple 18 thereof for nursing a child. It will also be evident that the under dress portion 11 is exposed and since it is of the same design and color as the outer dress portion 10, it blends in with the outer dress portion and thereby camouflages the fact that an area of the outer dress portion has been removed. It will be understood that the baby's head will completely hide the nipple of the woman's breast while it is being nursed and also it will be evident that there will not be any flap or garments covering the baby's head so that for all appearances, it will seem that the mother is simply holding the child close to her.

It will be understood that the left zipper 17 can remain zipped up and the right hand zipper for the panel 16 zipped downwardly to expose the woman's right breast for nursing the child with this breast if she so desires.

Figure 4:
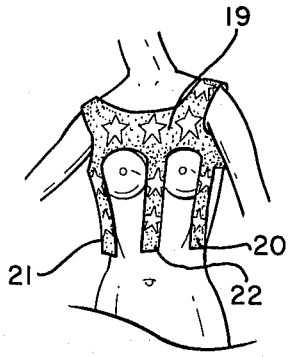
FIG. 4 shows a modified construction of the under dress portion in accord with a second embodiment; and, FIG. 5 shows how the dress functions to expose either one or both of the wearer's breasts.

Referring to FIG. 4, there is shown a modified type of under dress indicated at 19 wherein there are provided left and right outer strips 20 and 21 extending downwardly along the outer sides of the left and right breasts respectively, and a central strip 22 extending downwardly between the breasts. The ends of these strips may be attached to the inside waist portion of the outer dress, thereby providing further security for the under dress portion 19. In some instances, however, manufacturing of the entire dress can be facilitated by utilizing the preferred under dress portion as illustrated in FIG. 2. An advantage of the arrangement in FIG. 4 is that the possibility of the under dress 19 being pushed upwardly to expose the woman is inhibited by the provision of the downwardly extending strips which are fastened to the inside waist of the dress as described.

Figure 5:
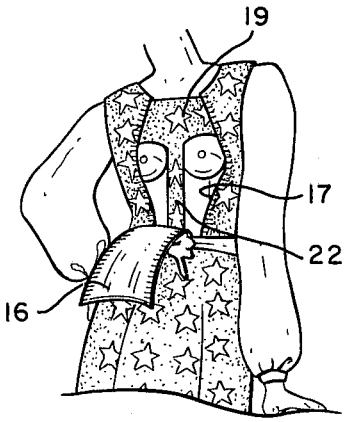

FIG. 5 shows the appearance of the under dress portion 19 when the panel 16 of the outer dress has been unzipped at both sides and folded downwardly. It will be noted that because again the design of the under dress is the same as that of the outer dress portion, the major area exposed by folding down of the panel 16 is camouflaged, only a small area exposing the nipples of the woman's breasts for nursing purposes.

From all of the foregoing, it will now be evident that the present invention has provided a greatly improved camouflaged type nursing dress. The dress itself can be smartly designed and the zippers as described neatly camouflaged themselves, as is possible with available zippers. By providing an under dress portion of the same color and design as the outer dress portion covering the woman's torso, minimum exposure results when the woman is nursing.

Minor changes falling within the scope and spirit of this invention will occur to those skilled in the art. The camouflaged nursing dress is therefore not to be thought of as limited to the exact embodiment set forth for illustrative purposes.

I claim:

1. A camouflaged nursing dress, including, in combination:

(a) an outer dress portion covering the torso and of a given color and design;

(b) an under dress portion covering the front of the torso from the inside upper front margin of the outer dress portion and extending downwardly over the top areas of the breasts to within a short distance of the nipples and of the same color and design as said outer dress portion;

(c) attachment means securing the shoulders and side arm portions of the under dress portion to corresponding parts of the inside of the outer dress portion; and (d) exposing means on the front of said outer dress portion for removing an area of said outer dress portion from in front of the torso to expose said under dress portion and uncovered areas of the breasts for nursing a child, the same color and design on the under dress portion blending in with the remaining front of the outer dress portion to camouflage the fact that an area of the outer dress portion has been removed.

2. A dress according to claim 1, in which said area of said outer dress portion that is removed constitutes a rectangular, generally vertical panel, the exposing means including zippers along the left and right longitudinal edges of the panel extending to the top of the panel so that zipping permits the panel to be folded downwardly to expose said under dress portion.

3. A dress according to claim 2, in which said under dress portion includes left and right outer strips extending downwardly along the outer sides of the left and right breasts respectively, and a central strip extending downwardly between the breasts, the ends of said strips being attached to the inside waist of said outer dress.

* * * * *